US008521052B2

(12) United States Patent
Kwak

(10) Patent No.: US 8,521,052 B2
(45) Date of Patent: Aug. 27, 2013

(54) IMAGE FORMING APPARATUS

(75) Inventor: Jun Suk Kwak, Gwangju-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 144 days.

(21) Appl. No.: 12/904,393

(22) Filed: Oct. 14, 2010

(65) Prior Publication Data

US 2011/0142481 A1 Jun. 16, 2011

(30) Foreign Application Priority Data

Dec. 15, 2009 (KR) ..... 10-2009-124697

(51) Int. Cl.
*G03G 21/20* (2006.01)

(52) U.S. Cl.
USPC ..... 399/92

(58) Field of Classification Search
USPC ..... 399/92, 93, 100
See application file for complete search history.

(56) References Cited

U.S. PATENT DOCUMENTS

| | | | | |
|---|---|---|---|---|
| 6,393,237 | B1 | 5/2002 | Shindo | |
| 2006/0222427 | A1* | 10/2006 | Kang et al. | 399/393 |
| 2007/0092287 | A1* | 4/2007 | Kojima | 399/93 |
| 2010/0111568 | A1* | 5/2010 | Takaya et al. | 399/170 |

FOREIGN PATENT DOCUMENTS

| | | |
|---|---|---|
| JP | 61-050170 | 3/1986 |
| JP | 04-128774 | 4/1992 |
| JP | 04-178666 | 6/1992 |
| JP | 06-035251 | 2/1994 |
| JP | 08-106198 | 4/1996 |
| JP | 08-171254 | 7/1996 |

OTHER PUBLICATIONS

Translation of Tokimatsu (JP,08-171254 A, listed in IDS, pub date: Feb. 7, 1996).*
EP Search Report issued Oct. 11, 2011 in EP Application No. 10187471.7.

* cited by examiner

*Primary Examiner* — Walter L Lindsay, Jr.
*Assistant Examiner* — Frederick Wenderoth
(74) *Attorney, Agent, or Firm* — Stanzione & Kim, LLP

(57) ABSTRACT

An image forming apparatus includes a corona charge device to charge a photoconductor. The corona charge device includes first and second shielding members arranged to shield most of a space between a surface of the photoconductor and the corona charge device, and a guide member to guide outside air stream to an outside air inlet. The image forming apparatus prevents damage and contamination of the photoconductor due to byproducts of corona discharge.

20 Claims, 8 Drawing Sheets

IMAGE FORMING APPARATUS

CROSS-REFERENCE TO RELATED APPLICATIONS

This application claims priority under 35 U.S.C. §119(a) from Korean Patent Application No. 2009-0124697, filed on Dec. 15, 2009 in the Korean Intellectual Property Office, the disclosure of which is incorporated in its entirety herein by reference.

BACKGROUND

1. Field of the Invention

Exemplary embodiments of the present general inventive concept relate to an image forming apparatus having a developing device assembly using a corona charge device.

2. Description of the Related Art

Generally, image forming apparatuses are devised to form an image on a printing medium according to input image signals. Examples of image forming apparatuses include printers, copiers, fax machines, and devices combining functions thereof.

In operation of an image forming apparatus, a laser beam is irradiated to a uniformly charged photoconductive medium according to a predetermined control signal, so as to form an electrostatic latent image. As the electrostatic latent image is developed into a visible image and in turn, the developed image is transferred to a printing medium, formation of an image is completed.

A corona charge device is used to uniformly charge a surface of the photoconductive medium. However, byproducts generated while the corona charge device performs corona discharge may be adsorbed to the surface of the photoconductive medium, thus preventing formation of a normal image.

Therefore, various methods have been tested to prevent formation of defective image due to the discharge byproducts generated by the corona charge device.

SUMMARY

Therefore, it is a feature of the present general inventive concept to provide an image forming apparatus to prevent formation of a defective image and contamination thereof due to discharge byproducts generated by a corona charge device.

Additional features of the general inventive concept will be set forth in part in the description which follows and, in part, will be obvious from the description, or may be learned by practice of the general inventive concept.

In accordance with one feature of the present general inventive concept, an image forming apparatus includes a photoconductor, and a corona charge device disposed adjacent to the photoconductor, wherein the corona charge device includes a discharge pin, a shield case to support the discharge pin therein, the shield case including a first portion, a second portion arranged at a rotational downstream direction of the photoconductor so as to face the first portion, an opening facing the photoconductor, and an exhaust hole to cause suction pressure within the shield case, a first shielding member to reduce a gap between the photoconductor and an upper end of the second portion of the shield case so as to define an outside air inlet through which outside air is introduced into the shield case, and a guide member having a guide surface protruding from an outer surface of the second portion to guide outside air around the shield case to the outside air inlet.

The corona charge device may further include a second shielding member to shield a gap between the photoconductor and an upper end of the first portion of the shield case.

The outside air inlet to introduce outside air may have a width of about 1.5 mm or less.

The image forming apparatus may further include a light scanning unit arranged beneath the photoconductor and serving to scan light to the photoconductor charged by the corona charge device so as to form an electrostatic latent image on the photoconductor.

The corona charge device may further include a screen installed at the opening of the shield case.

The first shielding member may be made of a rigid film, and the second shielding member may be made of a soft film.

An angle between the guide surface and a horizontal axis extending from the upper end of the second portion may be in a range of about 1 degree to about 90 degrees.

A ratio of a length from one end to an opposite end of the guide surface to a length from one end to an opposite end of the first portion may be in a range of about 0.3 cm to about 2.0 cm.

The image forming apparatus may further include a photoconductor housing in which the photoconductor is rotatably supported, and an intake duct installed to the photoconductor housing to extend in a longitudinal direction of the corona charge device, the intake duct serving to suction byproducts of corona discharge, generated within the shield case, through the exhaust hole.

The image forming apparatus may further include an exhaust duct in communication with the intake duct so as to discharge the discharge byproducts suctioned by the intake duct out of the image forming apparatus, the exhaust duct supporting a suction fan to generate the suction pressure.

In accordance with another feature of the present general inventive concept, an image forming apparatus includes a corona charge device disposed adjacent to a rotating photoconductor, the corona discharge device including a shield case from which byproducts of corona discharge are exhausted by a suction fan used to generate suction force, the shield case including a bottom portion and first and second portions extending from opposite ends of the bottom portion, and a discharge pin arranged between the first portion and the second portion, wherein the corona charge device further includes a first shielding member coupled to an upper end of the second portion so as to define an outside air inlet, having a width of about 1.5 mm or less, between a surface of the photoconductor and the upper end of the second portion disposed adjacent to a rotational downstream portion of the photoconductor, and a soft second shielding member to shield at least a part of a gap between the surface of the photoconductor and an upper end of the first portion disposed adjacent to a rotational upstream portion of the photoconductor.

The first shielding member may include a rigid film.

The second portion may be provided at an outer surface thereof with a guide member having a guide surface, along which outside air around the shield case flows to be guided to the outside air inlet.

In accordance with a further feature of the present general inventive concept, an image forming apparatus includes a rotating photoconductor, a corona charge device arranged near the photoconductor and including a discharge pin, a shield case encasing the discharge pin, a screen installed at an opening of the shield case facing the photoconductor, and an exhaust hole to cause suction pressure within the shield case, and a light scanning unit arranged beneath the photoconductor and serving to irradiate light to the charged photoconductor so as to form an electrostatic latent image on the photoconductor, wherein the corona charge device further includes a rigid first shielding member, one end of which is coupled to a second portion of the shield case and the other end is spaced apart from a surface of the photoconductor, the first shielding member serving to reduce a gap between the surface of the photoconductor and an upper end of the second portion disposed adjacent to a rotational downstream portion of the photoconductor so as to define an outside air inlet through which outside air is introduced into the shield case, and a soft second shielding member, one end of which is coupled to a first portion of the shield case and the other end comes into contact with the surface of the photoconductor, the second shielding member serving to shield a gap between the surface of the photoconductor and an upper end of the first portion disposed adjacent to a rotational upstream portion of the photoconductor.

A width of the outside air inlet defined by the first shielding member may be about 1.5 mm or less.

The second portion may be provided at an outer surface thereof with a guide member to guide air stream blown from the light scanning unit to the outside air inlet.

In yet another feature of the general inventive concept, a corona charge device includes a discharge pin to charge a photoconductor of an image forming apparatus, comprising a shield case surrounding the discharge pin to contain discharge byproducts generated by the discharge pin therein and including a first portion, a second portion disposed at a rotational downstream portion of the photoconductor facing the first portion, an opening facing the photoconductor, and an exhaust hole to exhaust the discharge byproducts in response to a suction pressure within the shield case, a guide member having a guide surface protruding from an outer surface of the second portion to guide outside air around the shield case, a first shielding member coupled to an upper end of the second portion to define an outside air inlet to receive the guided outside air and to introduce the outside air into the shield case, and a second shielding member disposed on an upper end of the first portion of the shield case to inhibit airflow between the photoconductor and the first portion of the shield case.

In another feature of the general inventive concept, a corona charge device includes a discharge pin to charge a photoconductor of an image forming apparatus, comprising a shield case surrounding the discharge pin and including a first portion and a second portion disposed at a rotational downstream portion of the photoconductor facing the first portion and an opening facing the photoconductor and an exhaust hole to discharge byproducts contained within the shield case, a guide member protruding from an outer surface of the second portion and including a guide surface extending at an inclined angle toward the photoconductor, and a first shielding member extending from the guide surface toward the photoconductor and disposed against an upper end of the second portion to define a gap between the photoconductor and the first shielding member that directs outside air therethrough to accelerate the discharge of byproducts through the exhaust hole.

In still another feature of the general inventive concept, a developing device assembly includes a photoconductor, comprising a photoconductor housing to support the photoconductor, a corona charge device including a shield case having a first portion and a second portion arranged at a rotational downstream portion of the photoconductor so as to face the first portion and an opening facing the photoconductor and an exhaust hole to cause suction pressure within the shield case, a first shielding member to reduce a gap between the photoconductor and an upper end of the second portion of the shield case so as to define an outside air inlet through which outside air is introduced into the shield case, and a support extending diagonally and downward from the photoconductor housing and coupled to the bottom portion of the shield case to tilt the shield case such that the first portion of the shield case extends above the second portion and into an inlet air path to direct the outside air into the shield case.

In yet another feature of the present general inventive concept, a method of preventing byproducts generated by a corona charge device from being adsorbed by a photoconductor comprises disposing a shield case having an exhaust hole included with the corona charger device adjacent to the photoconductor to create an air inlet between the photoconductor and the corona charge device, guiding outside air to an inlet air path that travels through the air inlet into the shield case such that the outside air flows through the air inlet, tilting the shield case to position a first portion of the shield case into the inlet air path to capture the outside air, and pressurizing the inside of the shield case to direct the byproducts away from the photoconductor and out of the shield case via the exhaust hole.

BRIEF DESCRIPTION OF THE DRAWINGS

These and/or other features of the general inventive concept will become apparent and more readily appreciated from the following description of the exemplary embodiments, taken in conjunction with the accompanying drawings of which.

DETAILED DESCRIPTION OF THE EMBODIMENTS

Figure 1:
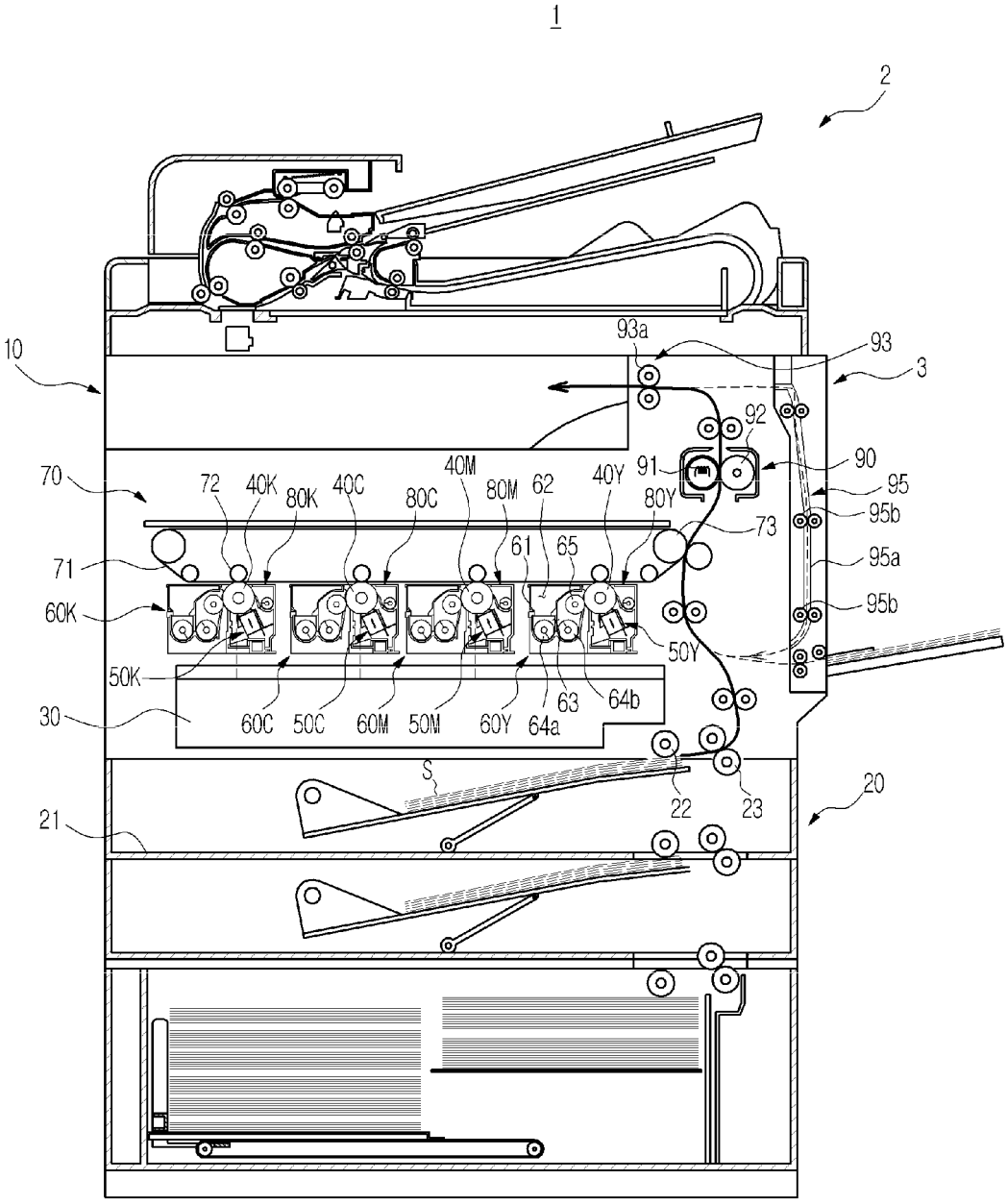
FIG. 1 is a sectional view illustrating a schematic configuration of an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

FIG. 1 is a view illustrating a schematic configuration of an image forming apparatus according to an exemplary embodiment of the present general inventive concept.

As illustrated in FIG. 1, the image forming apparatus 1 includes an image reading unit 2 to read an image recorded on a document, and a printing device 3 to print an image on a printing medium, such as paper.

The printing device 3 serves to print an image according to a signal input from the image reading unit 2 or an external appliance, such as a personal computer, etc. The printing device 3 includes a body 10, a paper supply unit 20, a light scanning unit 30, photoconductors 40K, 40C, 40M and 40Y, charge devices 50K, 50C, 50M and 50Y, developer reservoirs 60K, 60C, 60M and 60Y, a transfer unit 70, waste developer collectors 80K, 80C, 80M and 80Y, a fusing unit 90, a discharge unit 93, and a double-sided printing unit 95.

The body 10 defines an external appearance of the image forming apparatus and supports a variety of elements installed therein.

The paper supply unit 20 includes at least one cassette 21 in which printing media S is stored, a pickup roller 22 to pick up the printing media S stored in the cassette 21 sheet by sheet, and feed rollers 23 to feed the picked-up printing media S toward the transfer unit 70.

The light scanning unit 30 irradiates light, which corresponds to image information, to the photoconductors 40K, 40C, 40M and 40Y, so as to form electrostatic latent images on surfaces of the photoconductors 40K, 40C, 40M and 40Y.

The charge devices 50K, 50C, 50M and 50Y generate an electrical charge and may be disposed adjacent to and close to the photoconductors 40K, 40C, 40M and 40Y such that the electrical charge charges the photoconductors 40K, 40C, 40M and 40Y with a predetermined electric potential before the light scanning unit 30 irradiates light to the photoconductors 40K, 40C, 40M and 40Y. The charge devices may include a corona charge device using corona discharge, such as a corotron, scorotron, or dicorotron type device. Accordingly, electrostatic latent images may be formed on the surfaces of the respective photoconductors 40K, 40C, 40M and 40Y with the light irradiated from the light scanning unit 30.

The developer reservoirs 60K, 60C, 60M and 60Y supply developer to the electrostatic latent images formed on the photoconductors 40K, 40C, 40M and 40Y, so as to form visible images.

The respective developer reservoirs 60K, 60C, 60M and 60Y may receive different colors of developers, for example, black, cyan, magenta and yellow developers.

Each of the developer reservoirs, for example, the developer reservoir 60Y includes a case 61 in which a developer receiving chamber 62 and an agitating chamber 63 are defined, feed members 64*a* and 64*b* received in the agitating chamber 63, and a developing roller 65 to supply the developer from the agitating chamber 63 to the photoconductor 40Y.

For reference, although an exemplary embodiment hereinafter describes the developer reservoir 60Y by way of example, the following description may be equally applied to the remaining black, cyan and magenta developer reservoirs 60K, 60C and 60M.

The transfer unit 70 may include an intermediate transfer belt 71, first transfer rollers 72, and a second transfer roller 73.

The first transfer rollers 72 serve to transfer the visible images formed on the photoconductors 40K, 40C, 40M and 40Y to the intermediate transfer belt 71. Subsequently, the image on the intermediate transfer belt 71 is transferred to the printing medium S as the printing medium S supplied from the paper supply unit 20 passes between the second transfer roller 73 and the intermediate transfer belt 71.

The waste developer collectors 80K, 80C, 80M and 80Y serve to collect waste developer that remains on the photoconductors 40K, 40C, 40M and 40Y rather than being transferred to the intermediate transfer belt 71.

The fusing unit 90 may include a heating member 91 and a press roller 92. The heating member 91 may be of a roller type in which a heat source is supported, or may be of a belt type to be heated by a heat source.

As the printing medium S, to which the image has been transferred, passes between the heating member 91 and the press roller 92, the image is fixed to the printing medium S by heat and pressure.

The printing medium S having passed through the fusing unit 90 is guided to the discharge unit 93 and is discharged out of the body 10 of the printing device 3 by discharge rollers 93*a*.

The double-sided printing unit 95 may return the printing medium S, on one surface of which the image has been completely formed, so that the printing medium S again passes between the second transfer roller 73 and the intermediate transfer belt 71, thus allowing images to be printed on both surfaces of the printing medium S.

The double-sided printing unit 95 may include a double-sided printing guide 95*a* defining a return path of the printing medium S, and return rollers 95*b* installed on the return path of the printing medium S to feed the printing medium S.

To perform a double-sided printing operation, the printing medium S, on one surface of which an image has been completely formed, is inverted at a predetermined time in the course of being moved by the discharge rollers 93*a* and is guided to the double-sided printing guide 95*a*. Subsequently, the inverted printing medium S is fed by the return rollers 95*b* to again pass between the second transfer roller 73 and the intermediate transfer belt 71, thereby allowing another image to be formed on the other surface of the printing medium S.

Figure 2:
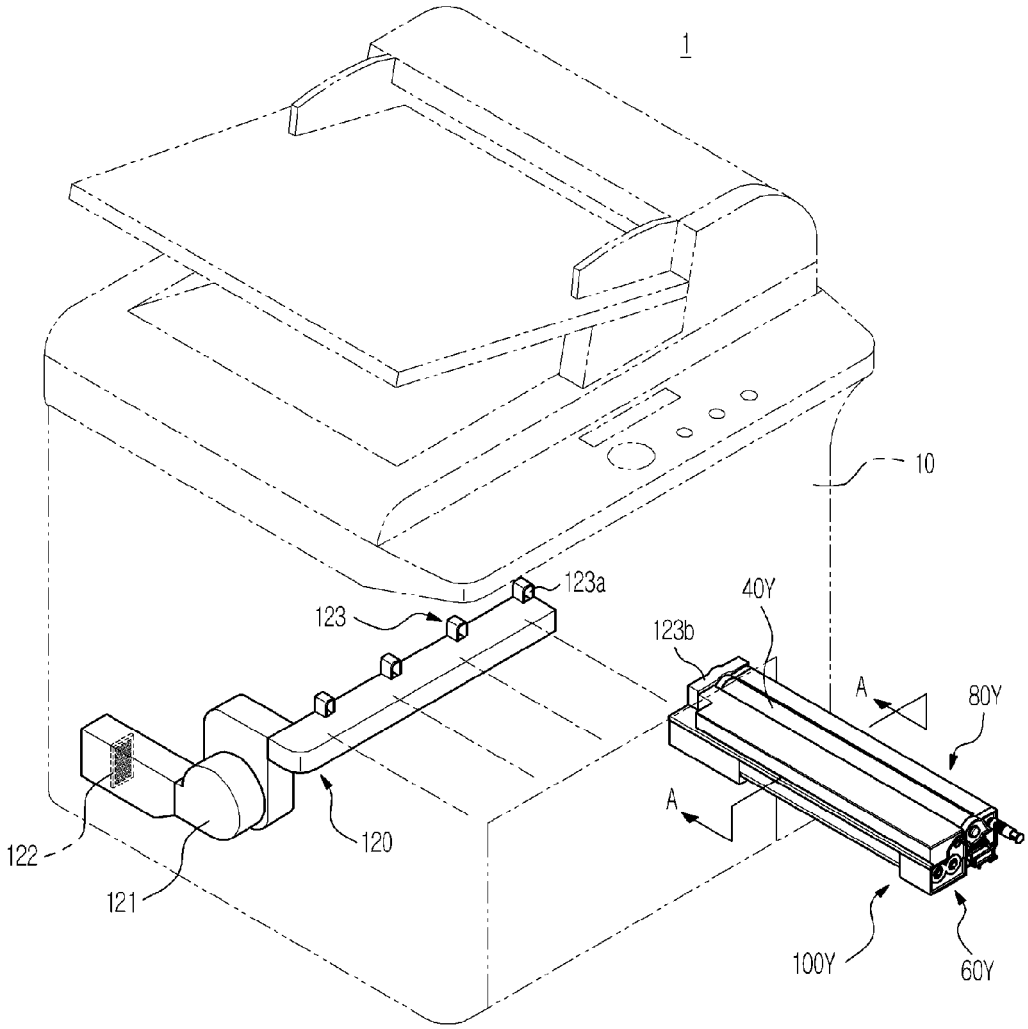
FIG. 2 is a perspective view illustrating a developing device assembly and an exhaust duct according to the exemplary embodiment.
Figure 3:
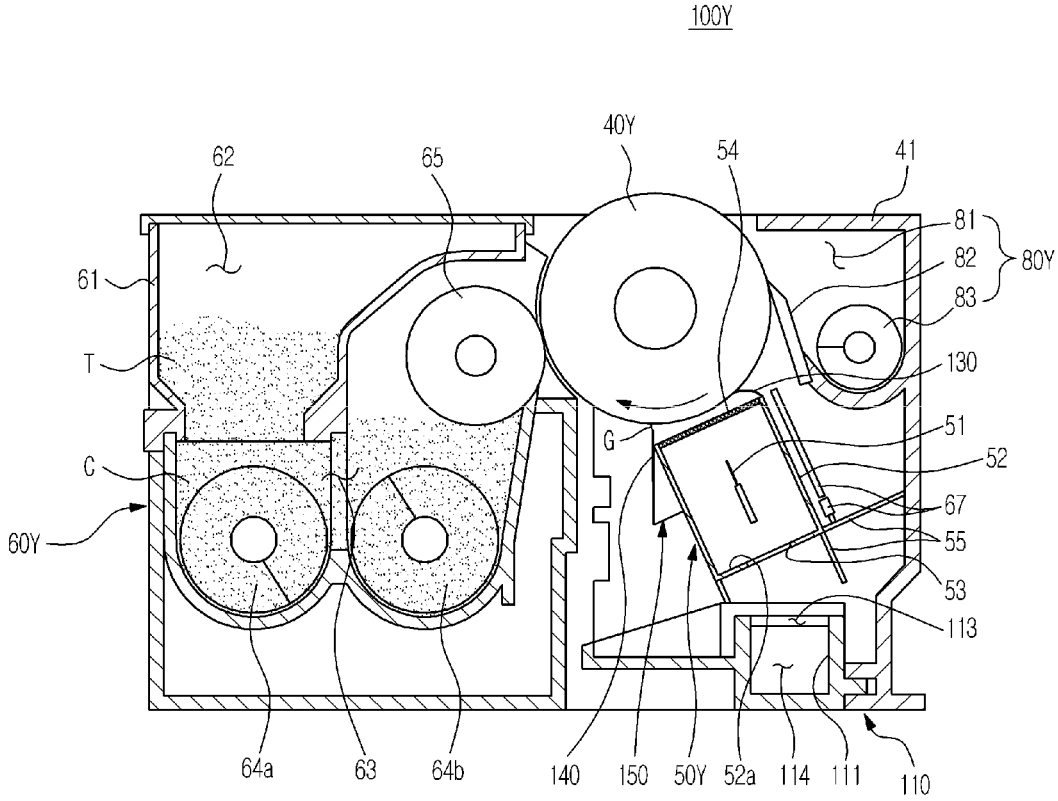
FIG. 3 is a sectional view taken along line A-A of FIG. 2.
Figure 4:
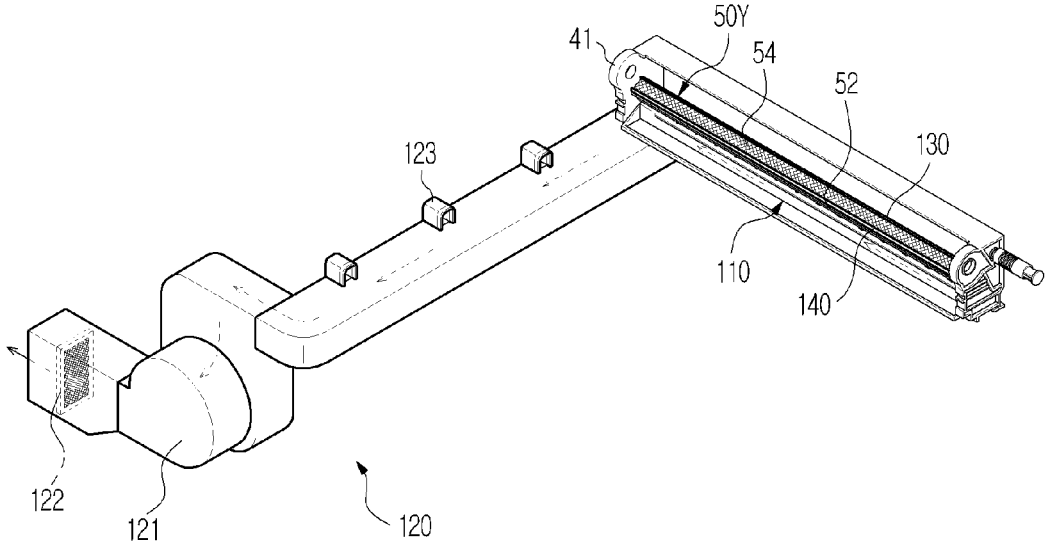
FIG. 4 is a view illustrating a blowing structure according to an exemplary embodiment.
Figure 5:
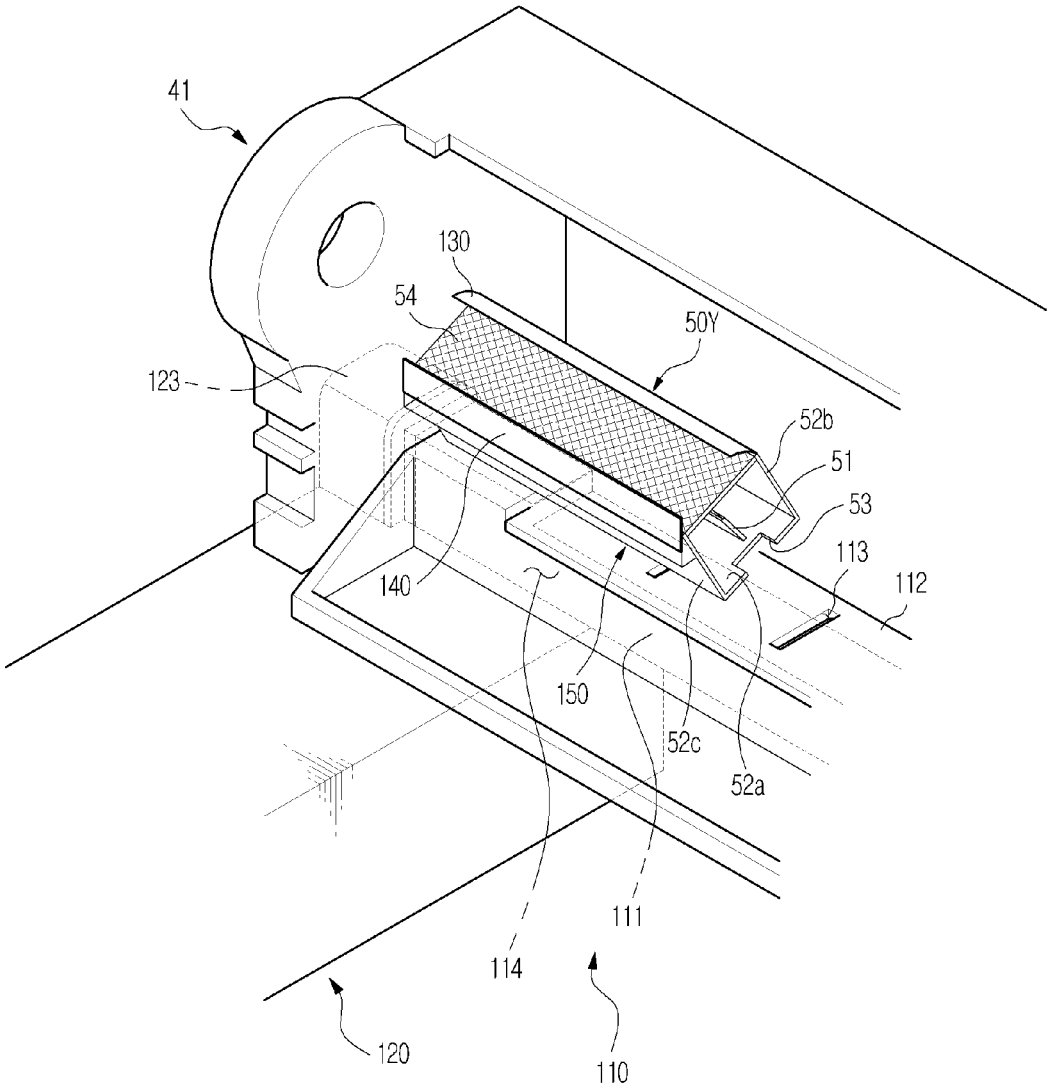
FIG. 5 is a perspective view illustrating a charge device and an intake duct according to an exemplary embodiment.

FIG. 2 is a perspective view illustrating a developing device assembly and an exhaust duct according to an exemplary embodiment, FIG. 3 is a sectional view taken along line A-A of FIG. 2, FIG. 4 is a view illustrating a blowing structure according to an exemplary embodiment, and FIG. 5 is a perspective view illustrating a charge device and an intake duct according to an exemplary embodiment.

Referring to FIG. 2, the image forming apparatus 1 of an exemplary embodiment includes a developing device assembly 100Y including the photoconductor 40Y, the developer reservoir 60Y, the waste developer collector 80Y, and the charge device 50Y. The developing device assembly 100Y may be separated from the body 10 to replace developer and/or exchange various parts therein. When the developing device assembly 100Y is mounted into the body 10, the developing device assembly 100Y may be connected to an exhaust duct 120.

Although the exemplary embodiments hereinafter describes the developing device assembly 100Y in which yellow developer is stored and thus, the photoconductor 40Y carries a yellow developer image thereon, the following description may be equally applied to another color developing device assembly.

Referring to FIG. 3, the photoconductor 40Y may be rotatably disposed in a photoconductor housing 41.

The developer reservoir 60Y may include the case 61 in which the developer receiving chamber 62 and the agitating chamber 63 are defined. Feed members 64*a* and 64*b* may be disposed in the agitating chamber 63. The developing roller 65 supplies the developer of the agitating chamber 63 to the photoconductor 40Y.

The developer T received in the developer receiving chamber 62 is supplied into the agitating chamber 63, where it may be agitated by the two feed members 64*a* and 64*b*. During agitation, the developer T is electrically charged via friction between the developer T and carrier C. The developing roller 65 attaches the electro-statically charged developer T to the photoconductor 40Y on which an electrostatic latent image has been formed, so as to develop the electrostatic latent image into a visible image.

The waste developer collector 80Y includes a cleaning blade 82 to scrape and collect waste developer remaining on the photoconductor 40Y, a collecting chamber 81 defined in the photoconductor housing 41 to store the collected waste developer, and an agitating member 83 to agitate the waste developer stored in the collecting chamber 81.

Referring to FIGS. 3 to 5, the charge device 50Y serves to charge the photoconductor 40Y, which has passed through an anti-static device 67, with a predetermined electric potential. As mentioned above, the charge device 50Y may be a corona charge device using corona discharge, such as a corotron, scorotron, or dicorotron type device.

The corona charge device 50Y may include a discharge pin 51 to receive a voltage. In response to the voltage, the discharge pin 51 discharges an ionized corona that may charge the photoconductor 40Y. The corona charge device 50Y may further include a shield case 52 to encase the discharge pin 51.

The shield case 52 may extend parallel to a longitudinal direction of the photoconductor 40Y and may have an approximately U-shaped cross section having an opening facing the photoconductor 40Y. More specifically, the shield case 52 includes a bottom portion 52*a* and first and second portions 52*b* and 52*c*, respectively, each extending from opposite ends of the bottom portion 52*a*. The opening of the shield case 52 is positioned to maintain a predetermined gap with the surface of the photoconductor 40Y. Additionally, a support 55 may be included to support the shield case 52. The support 55 may extend diagonally and downward from an inner surface of the photoconductor housing 41. The bottom surface of the shield case 52 may be disposed on the support 55, thereby tilting the shield case 52.

The bottom portion 52*a* of the shield case 52 is provided with an exhaust hole 53 through which byproducts of corona discharge, including but limited to nitrous oxide (NOx), ozone, etc., may be discharged from the shield case 52. A screen 54 may be installed at the opening of the shield case 52 facing the photoconductor 40Y. Accordingly, the discharge of the byproducts may be controlled to reduce the negative affects the byproducts have on an image formed on a photoconductive medium.

In operation of the corona charge device 50Y, a high voltage of approximately 7 KV is applied to the discharge pin 51, and a constant voltage of approximately 600V to 700V, i.e. an electric potential to charge the photoconductor 40Y, is applied to the shield case 52. Accordingly, the surface of the photoconductor 40Y is charged with current via corona discharge of the discharge pin 51. In this case, byproducts of corona discharge, such as ozone, NOx, etc., are generated within the shield case 52.

The image forming apparatus may further include an intake duct 110 to exhaust the discharge byproducts from within the shield case 52, and an exhaust duct 120 to disposed to communicate with the intake duct 110 such that the discharge byproducts may be exhausted from the image forming apparatus 110. A suction fan 121 may also be included to generate a suction pressure within the shield case 52. The suction fan 121 may disposed at an end of the exhaust duct 120 to draw the discharge byproducts out of the shield case and exhaust the discharge byproducts from an outlet of the fan 121.

The intake duct 110 includes a base frame 111 that may be integrally formed with the photoconductor housing 41 and a cover 112 configured to cover the base frame 111. The cover 112 may further include a plurality of intake holes 113. The base frame 111 and the cover 112 may define a path 114 in the intake duct 110 to direct the discharge byproducts. The path 114 of the intake duct 110 communicates with the exhaust duct 120 through a coupling unit 123 of the exhaust duct 120.

The coupling unit 123 may comprise a first coupling member 123(*a*) included with the exhaust duct 120, and a second coupling member 123(*b*) included with the developing device assembly 100Y. Accordingly, the first coupling member 123 (*a*) may be coupled to the second coupling member 123(*b*) such that the intake duct 110 is disposed in fluid communication with the exhaust duct 120. Thus, the byproducts may directed from within the shield case 52 to intake duct 110, and travel along the path 114 where the byproducts are exhausted through exhaust duct 120.

The exhaust duct 120 may be provided with a filter 122. The filter may be disposed about the outlet of the fan to filter the exhausted discharge byproducts.

With the above described configuration, the discharge byproducts generated within the shield case 52 are directed through the exhaust hole 53 by suction force of the suction fan 121 and thereafter, are discharged out of the image forming apparatus through the intake duct 110 and the exhaust duct 120.

In this case, complex airflow, such as eddy, may be generated within the shield case 52 because of interference or pressure difference between ion wind generated by the discharge pin 51, air stream generated by rotation of the photoconductor 40Y, air stream generated by a fan of the light scanning unit 30, and air stream generated by the suction fan 121 used to exhaust the discharge byproducts.

The eddy may prevent exhaust of the discharge byproducts, thereby causing the discharge byproducts to be accumulated in the shield case 52. The accumulated discharge byproducts may be adsorbed to the surface of the photoconductor 40Y, thus causing formation of a defective image.

Accordingly, the charge device 50Y may include a first shielding member 140 and a second shielding member 130 to reduce the undesirable affects caused by the eddy. The first shielding member 140 serves to reduce a gap between the photoconductor 40Y and an upper end of the second portion 52*c* of the shield case 52 located close to a rotational downstream portion of the photoconductor 40Y so as to increase an interior suction pressure of the shield case 52. The second shielding member 130 serves to shield a gap between the photoconductor 40Y and an upper end of the first portion 52*b* of the shield case 52 located close to a rotational upstream portion of the photoconductor 40Y, thereby preventing air from flowing between the photoconductor 40Y and the first portion 52*b* of the shield member 52. Accordingly, the suction pressure within the shield case may be increased.

Figure 6:
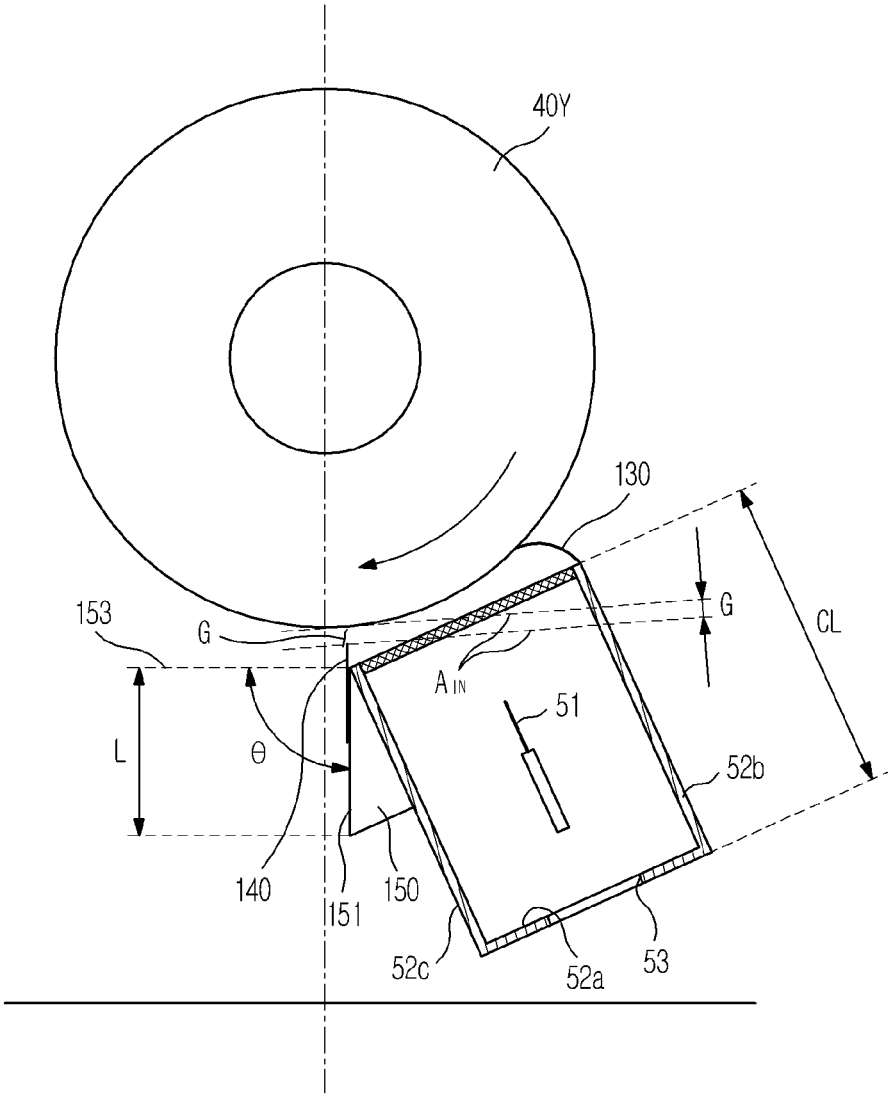
FIG. 6 is a view illustrating a relationship between a photoconductor and the charge device according to an exemplary embodiment.

Referring to FIG. 6, the second shielding member 130 may be a soft film member made of a material, including but not limited to, flexible plastic, rubber, etc. One end of the second shielding member 130 is coupled to the upper end of the first portion 52*b*. The second shielding member 130 extends from the first portion 52*b* to dispose the other end into contact with the surface of the photoconductor 40Y. The second shielding member may have a length that is greater than the gap between the first portion 52*b* and the photoconductor 40Y such that the second shielding member flexes as the photoconductor 40Y rotates, while providing a seal to prevent air from flowing therebetween.

The first shielding member 140 may be a rigid film member, made of a material including, but not limited to rigid plastic, metal, etc. One end of the first shielding member 140 is coupled to the upper end of the second portion 52*c* and extends upward to the other end, which is spaced apart from the surface of the photoconductor 40Y by a predetermined gap G. Alternatively, the first shielding member may be coupled to the guide surface and extend therefrom and above the top of the second portion 52C to define the gap G.

The gap G between the first shielding member 140 and the surface of the photoconductor 40Y may serve as an outside air inlet G to guide outside air into the shield case 52 along an inlet air path ($A_{IN}$) that is perpendicular to the first shielding member 140, while preventing defective charge of the photoconductor 40Y.

As discussed above, the bottom portion 52*a* of the shield case 52 may be disposed on the support 55 to tilt the shield case 52. Accordingly, the first portion 52*b* of the shield case 52 may be positioned into the inlet air path such that the first portion 52*b* captures the outside air and directs the outside into the shield case 52.

The gap G serving as the outside air inlet G may have a width of approximately 1.5 mm or less. In this case, an increased suction pressure may be induced within the shield case 52 owing to a low interior pressure thereof and thus, introduction of fresh outside air through the outside air inlet G may be accelerated.

This may prevent the discharge byproducts generated within the shield case 52 from being accumulated near the surface of the photoconductor 40Y, thus preventing damage to the photoconductor 40Y due to the discharge byproducts.

The charge device 50Y may include a guide member 150 disposed at an upper portion of an outer surface of the second portion 52*c* to guide air stream flowing from the light scanning unit 30 to the outside air inlet G.

The guide member 150 may further include a guide surface 151. The guide surface 151 extends downward from the upper end of the second portion 52*c* and protrudes from an outer surface of the second portion 52*c*, thus allowing outside air to flow along the guide surface 151.

The guide surface 151 may have an inclination angle $\Theta_{in}$ ranging from about 1 to about 90 degrees with respect to a horizontal axis 153 extending from the upper end of the second portion 52*c*. A ratio of a length L from one end to an opposite end of the guide surface 151 to a length CL from one end to an opposite end of the second portion 52*c* may range from about 0.3 cm to about 2.0 cm.

The photoconductor 40Y, shield case 52, waste developer 80, and intake duct 110 may be formed in a single monolithic photoconductor housing 41. The photoconductor housing 41 may include hubs 42 to receive a shaft of the photoconductor 40Y to support the photoconductor 40Y therein. The shield case 52 may then be disposed adjacent the photoconductor 40Y on the support 55, which tilts the shield case 52 a predetermined angle such that the opening of the shield case faces the photoconductor 40Y, as discussed above. The waste developer 80 may be coupled to the shield case 52 opposite the opening to capture expelled developer. The intake duct 110 may be coupled to the bottom of the shield case 52 and supported by the photoconductor housing 41 to provide a path to expel the discharged byproducts from within the shield case 52.

Figure 7:
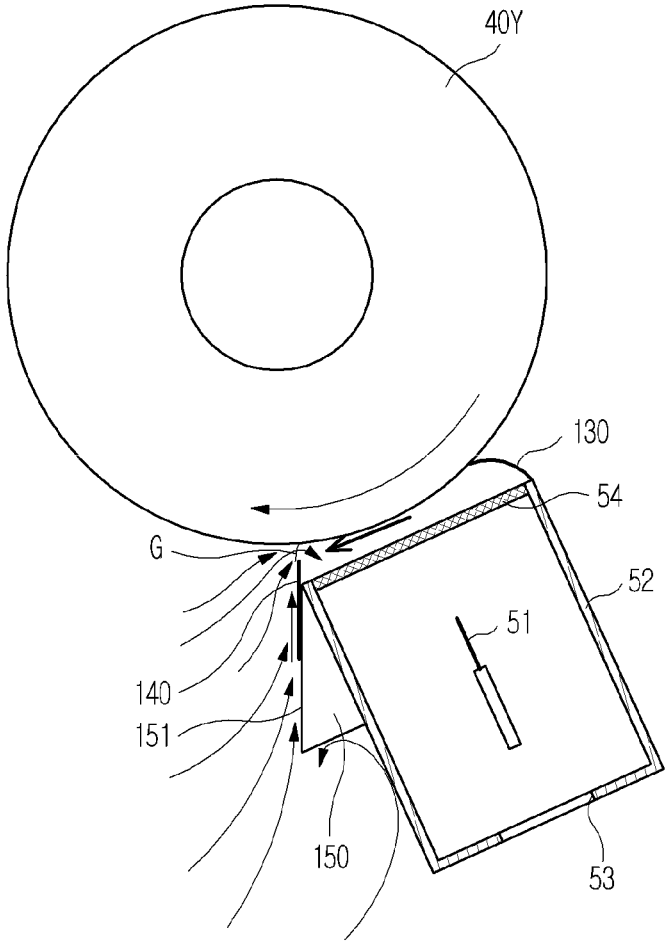
FIG. 7 is a view illustrating flow of outside air around the charge device according to an exemplary embodiment.

Hereinafter, an exemplary operation of the charge device will be described. FIG. 7 illustrates flow of outside air around the charge device according to an exemplary embodiment.

First, in the case where the photoconductor 40Y is charged with a predetermined electric potential by corona discharge, byproducts of corona discharge, such as ozone, NOx, etc., are generated within the shield case 52 of the charge device 50Y. The interior air of the shield case 52 containing the discharge byproducts is directed through the exhaust hole 53 of the shield case 52 by suction force induced by the suction fan 121 included with the exhaust duct 120 and thereafter, is discharged out of the body 1 through the intake duct 110 and the filter 122 of the exhaust duct 120.

In this case, since a space between the photoconductor 40Y and the opening of the shield case 52 located adjacent to the surface of the photoconductor 40Y is substantially kept airtight by the second shielding member 130 and the first shielding member 140, the charge device 50Y of at least one exemplary embodiment realizes an increased interior suction pressure of the shield case 52 thus allowing outside air to be rapidly introduced into the air inlet G and consequently, preventing the discharge byproducts from being accumulated within the shield case 52.

Further, even if operation of the suction fan 121 suddenly stops upon breakdown of electric current, the shield case 52 already realizes a sufficient pressure difference between the inside and outside thereof, enabling fresh outside air to be introduced into the shield case 52 through the air inlet G. As the introduced air pushes the discharge byproducts accumulated in an upper region of the shield case 52 downward, it may be possible to prevent the discharge byproducts from being discharged into the air inlet G or being adsorbed to the photoconductor 40Y.

The outside air around a lower portion of the shield case 52 is guided into the air inlet G by the guide surface 151 of the guide member 150. This assures not only smooth introduction of air into the shield case 52, but also effective use of air stream blown from the fan of the light scanning unit 30, located beneath the photoconductor housing 41, to the charge device 50Y. Consequently, it may be possible to more effectively prevent damage and contamination of the photoconductor 40Y due to the discharge byproducts generated within the shield case 52.

In at least one exemplary embodiment of the image forming apparatus, the guide surface 151 may have an inclination angle of about 1 to about 90 degrees with respect to the horizontal axis 153 of the guide surface 151, a ratio of the length L of the guide surface 151 to the length CL of the second portion 52*c* is in a range of about 0.3 cm to about 2.0 cm, and the air inlet G has a width of 1.5 mm or less. It has been found that this configuration may remarkably improve introduction of outside air into the air inlet G.

Figure 8:
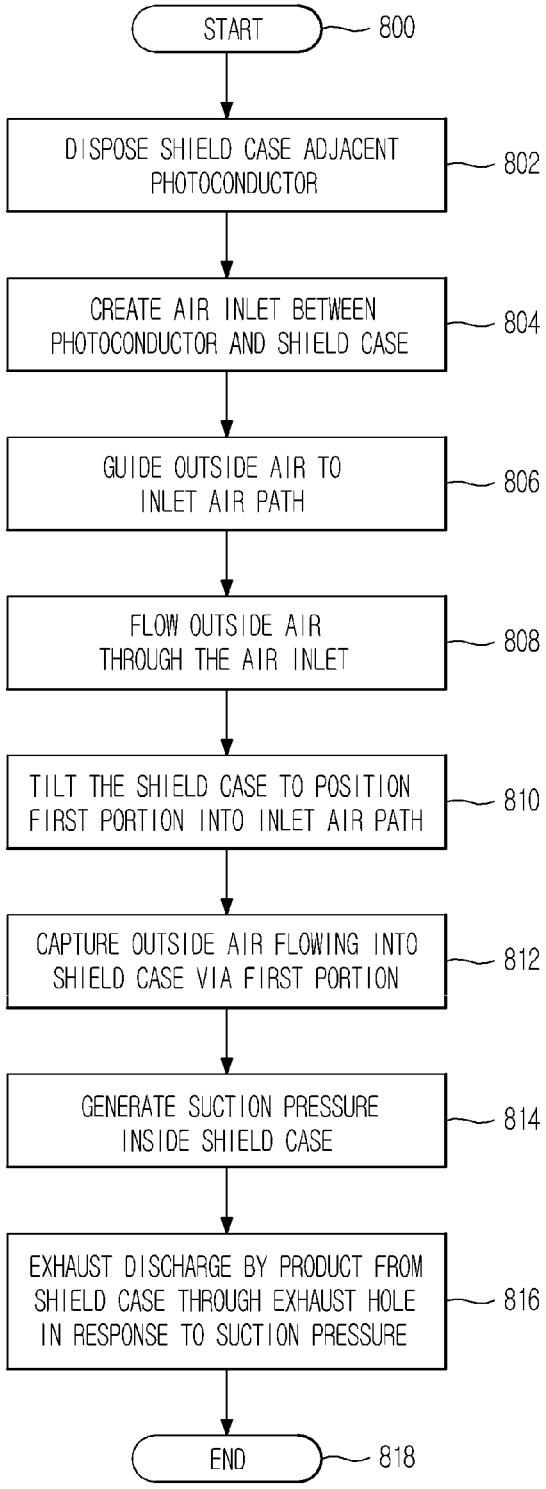
FIG. 8 is a flowchart illustrating a method of preventing byproducts generated by a corona charge device from being adsorbed by a photoconductor.

Referring now to FIG. 8, a method of preventing byproducts generated by a corona charge device from being adsorbed by a photoconductor will be described. The method begins at operation 800 and proceeds to operation 802 where a shield case 52, which surrounds a discharge pin 51 of a corona charge device 50Y, is disposed adjacent to and near a photoconductor 40Y. Accordingly, the discharge pin 51 may charge the photoconductor 52, while the shield case 52 contains discharge byproducts generated by the discharge pin 51. In operation 804, an air inlet is created between the photoconductor 40Y and the shield case 52. The width of the air inlet based on the disposition of the shield case 52 in operation 802. In operation 806, outside air is guided to an inlet air path that travels through the air inlet into the shield case 52. As outside air is guided to the air inlet path, the outside air flows into the shield case 52 via the air inlet path in operation 808. In operation 810, the shield case 52 is tilted such that a first portion 52*b* of the shield case is disposed into the inlet air path. As the first portion 52*b* is disposed into the inlet air path, the outside air flowing into the shield case 52 is contacts the first portion 52*b*, and inhibited from escaping the shield case 52 in operation 812. In operation 814, a suction pressure is induced within the shield case 52. In response to the suction pressure, air within the shield case 52, including the discharge byproduct, is exhausted from the shield case via an exhaust hole in operation 816, and the method ends in operation 818.

Accordingly, the discharge byproduct generated by the discharge pin may be prevented from being adsorbed by the photoconductor 40Y.

As apparent from the above description, an image forming apparatus according to an exemplary embodiment of the present general inventive concept may accelerate suction of fresh outside air by increasing the interior suction pressure of a charge device and effectively using outside air stream, thereby preventing damage and contamination of a photoconductor due to discharge byproducts accumulated in the charge device.

Although exemplary embodiments of the present general inventive concept have been shown and described, it would be appreciated by those skilled in the art that changes may be made to the exemplary embodiments without departing from the principles and spirit of the general inventive concept, the scope of which is defined in the claims and their equivalents.

What is claimed is:

1. An image forming apparatus comprising:

a photoconductor; and a corona charge device disposed adjacent to the photoconductor, wherein the corona charge device includes:

a discharge pin;

a shield case to support the discharge pin therein, the shield case including a first portion, a second portion arranged at a rotational downstream portion of the photoconductor so as to face the first portion, an opening facing the photoconductor, and an exhaust hole to cause suction pressure within the shield case;

a first shielding member to reduce a gap between the photoconductor and an upper end of the second portion of the shield case so as to define an outside air inlet through which outside air is introduced into the shield case;

a second shielding member, one end of which is coupled to a first portion of the shield case and the other end comes into contact with the surface of the photoconductor; and a guide member having a guide surface protruding from an outer surface of the second portion to guide outside air around the shield case to the outside air inlet.

2. The image forming apparatus according to claim 1, wherein the corona charge device further includes a second shielding member to shield a gap between the photoconductor and an upper end of the first portion of the shield case.

3. The image forming apparatus according to claim 1, wherein the outside air inlet to introduce outside air has a width of about 1.5mm or less.

4. The image forming apparatus according to claim 1, further comprising a light scanning unit arranged beneath the photoconductor and serving to scan light to the photoconductor charged by the corona charge device so as to form an electrostatic latent image on the photoconductor.

5. The image forming apparatus according to claim 1, wherein the corona charge device further includes a screen installed at the opening of the shield case.

6. The image forming apparatus according to claim 2, wherein the first shielding member is made of a rigid film, and the second shielding member is made of a soft film.

7. The image forming apparatus according to claim 6, wherein an angle between the guide surface and a horizontal axis extending from the upper end of the second portion is in a range of about 1degree to about 90degrees.

8. The image forming apparatus according to claim 6, wherein a ratio of a length from one end to an opposite end of the guide surface to a length from one end to an opposite end of the first portion is in a range of about 0.3cm to about 2.0cm.

9. The image forming apparatus according to claim 1, further comprising:

a photoconductor housing in which the photoconductor is rotatably disposed; and an intake duct installed to the photoconductor housing to extend in a longitudinal direction of the corona charge device, the intake duct serving to suction byproducts of corona discharge, generated within the shield case, through the exhaust hole.

10. The image forming apparatus according to claim 9, further comprising an exhaust duct in communication with the intake duct so as to discharge the discharge byproducts suctioned by the intake duct out of the image forming apparatus, the exhaust duct supporting a suction fan to generate the suction pressure.

11. An image forming apparatus comprising a corona charge device disposed adjacent to a rotating photoconductor and including a shield case from which byproducts of corona discharge are exhausted by a suction fan used to generate suction force, the shield case including a bottom portion and first and second portions extending from opposite ends of the bottom portion, and a discharge pin arranged between the first portion and the second portion, wherein the corona charge device further includes:

a first shielding member coupled to an upper end of the second portion so as to define an outside air inlet, having a width of about 1.5mm or less, between a surface of the photoconductor and the upper end of the second portion disposed adjacent to a rotational downstream portion of the photoconductor; and a soft second shielding member extending from an upper end of the first portion such that an end of the soft second shielding member remains in contact with a surface of the photoconductor to shield at least a part of a gap between the surface of the photoconductor and an upper end of the first portion disposed adjacent to a rotational upstream portion of the photoconductor.

12. The image forming apparatus according to claim 11, wherein the first shielding member includes a rigid film.

13. The image forming apparatus according to claim 11, wherein the second portion is provided at an outer surface thereof with a guide member having a guide surface along which outside air around the shield case flows to be guided to the outside air inlet.

14. An image forming apparatus comprising:

a rotating photoconductor;

a corona charge device arranged near the photoconductor and including a discharge pin, a shield case encasing the discharge pin, a screen installed at an opening of the shield case facing the photoconductor, and an exhaust hole to cause suction pressure within the shield case; and a light scanning unit arranged beneath the photoconductor and serving to irradiate light to the charged photoconductor so as to form an electrostatic latent image on the photoconductor, wherein the corona charge device further includes:

a rigid first shielding member, one end of which is coupled to a second portion of the shield case and the other end is spaced apart from a surface of the photoconductor, the first shielding member serving to reduce a gap between the surface of the photoconductor and an upper end of the second portion disposed adjacent to a rotational downstream portion of the photoconductor so as to define an outside air inlet through which outside air is introduced into the shield case; and a soft second shielding member, one end of which is coupled to a first portion of the shield case and the other end comes into contact with the surface of the photoconductor, the second shielding member serving to shield a gap between the surface of the photoconductor and an upper end of the first portion disposed adjacent to a rotational upstream portion of the photoconductor.

15. The image forming apparatus according to claim 14, wherein a width of the outside air inlet defined by the first shielding member is about 1.5mm or less.

16. The image forming apparatus according to claim 15, wherein the second portion is provided at an outer surface thereof with a guide member to guide air stream blown from the light scanning unit to the outside air inlet.

17. A corona charge device including a discharge pin to charge a photoconductor of an image forming apparatus, comprising:

a shield case surrounding the discharge pin to contain discharge byproducts generated by the discharge pin therein and including a first portion, a second portion disposed at a rotational downstream portion of the photoconductor facing the first portion, an opening facing the photoconductor, and an exhaust hole to exhaust the discharge byproducts in response to a suction pressure within the shield case;

a guide member having a guide surface protruding from an outer surface of the second portion to guide outside air around the shield case;

a first shielding member coupled to an upper end of the second portion to define an outside air inlet to receive the guided outside air and to introduce the outside air into the shield case; and a second shielding member disposed on an upper end of the first portion of the shield case and comes into contact with the surface of the photoconductor to inhibit airflow between the photoconductor and the first portion of the shield case.

18. A corona charge device including a discharge pin to charge a photoconductor of an image forming apparatus, comprising:

a shield case surrounding the discharge pin and including a first portion and a second portion disposed at a rotational downstream portion of the photoconductor facing the first portion and an opening facing the photoconductor and an exhaust hole to discharge byproducts contained within the shield case;

a guide member protruding from an outer surface of the second portion and including a guide surface extending at an inclined angle toward the photoconductor;

a first shielding member extending from the guide surface toward the photoconductor and disposed against an upper end of the second portion to define a gap between the photoconductor and the first shielding member that directs outside air therethrough to accelerate the discharge of byproducts through the exhaust hole; and a second shielding member extending from an upper end of the first portion such that an end of the second shielding member remains in contact with a surface of the photoconductor.

19. A developing device assembly including a photoconductor, comprising:

a photoconductor housing to support the photoconductor;

a corona charge device including a shield case having a first portion and a second portion arranged at a rotational downstream portion of the photoconductor so as to face the first portion and an opening facing the photoconductor and an exhaust hole to cause suction pressure within the shield case;

a first shielding member to reduce a gap between the photoconductor and an upper end of the second portion of the shield case so as to define an outside air inlet through which outside air is introduced into the shield case;

a second shielding member to shield a gap between the photoconductor and an upper end of the first portion of the shield case and the second shielding member comes into contact with a surface of the photoconductor; and a support extending diagonally and downward from the photoconductor housing and coupled to the bottom portion of the shield case to tilt the shield case such that the first portion of the shield case extends above the second portion and into inlet air path to direct the outside air into the shield case.

20. The developing device of claim 19 further comprising:

a guide member having a guide surface protruding from an outer surface of the second portion to guide outside air around the shield case to the outside air inlet.

* * * * *